US007819633B2

(12) United States Patent
Qian et al.

(10) Patent No.: US 7,819,633 B2
(45) Date of Patent: Oct. 26, 2010

(54) SPUTTER ION PUMP

(75) Inventors: Li Qian, Beijing (CN); Jie Tang, Beijing (CN); Liang Liu, Beijing (CN); Jing Qi, Beijing (CN); Pi-Jin Chen, Beijing (CN); Zhao-Fu Hu, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 975 days.

(21) Appl. No.: 11/478,421

(22) Filed: Jun. 28, 2006

(65) Prior Publication Data

US 2010/0247333 A1 Sep. 30, 2010

(30) Foreign Application Priority Data

Jul. 8, 2005 (CN) ..... 2005 1 0035928

(51) Int. Cl.
*F04B 37/02* (2006.01)

(52) U.S. Cl. ..... 417/48; 417/49

(58) Field of Classification Search ..... 417/48–49, 417/50; 313/31, 359.1, 360.1, 361.1, 362.1, 313/363.1

See application file for complete search history.

(56) References Cited

U.S. PATENT DOCUMENTS 3,169,693 A * 2/1965 Herzog ..... 417/49
3,217,974 A * 11/1965 Knauer ..... 417/49
3,719,852 A * 3/1973 Goody ..... 313/31
4,334,829 A * 6/1982 Harbaugh ..... 417/49
5,655,886 A * 8/1997 Alderson ..... 417/49
6,111,252 A * 8/2000 Pierrejean ..... 250/288
7,149,085 B2 * 12/2006 Chebiam et al. ..... 361/699
2005/0249618 A1 * 11/2005 Nonaka et al. ..... 417/423.4

* cited by examiner

*Primary Examiner*—Devon C Kramer
*Assistant Examiner*—Todd D Jacobs
(74) *Attorney, Agent, or Firm*—Jeffrey T. Knapp

(57) ABSTRACT

A sputter ion pump includes one vacuum chamber, two parallel anode poles and one cold cathode electron emitter. The vacuum chamber includes at least one aperture located in an outer wall thereof. The two parallel anode poles are positioned in the vacuum chamber and arranged in a symmetrical configuration about a center axis of the vacuum chamber. The cold cathode electron emission device is located on or proximate the outer wall of the vacuum chamber and faces a corresponding aperture. The cold cathode electron emission device is thus configured for injecting electrons through the corresponding aperture and into the vacuum chamber. The sputter ion pump produces a saddle-shaped electrostatic field and is free of a magnetic field. The sputter ion pump has a simplified structure and a low power consumption.

20 Claims, 5 Drawing Sheets

SPUTTER ION PUMP

BACKGROUND

1. Field of the Invention

The present invention relates to a vacuum pump known as a sputter ion pump and, more particularly, relates to a sputter ion pump that has a saddle-shaped electrostatic field and that is free of magnetic field.

2. Discussion of Related Art

A sputter ion pump is a kind of vacuum pump. A conventional sputter ion pump generally includes a cathode and anode electrode, with a high voltage applied therebetween. Electrons spirally move in a high magnetic field and collide with gas molecules. This collision ionizes the gas molecules. The cathode electrode is subjected to a sputtering process by means of the ionized gas molecules activating the surfaces thereof. The ionized gas molecules are absorbed on and/or embedded in the active surfaces of the cathode electrode; and/or are caught by the surfaces of the anode electrode, thereby performing an evacuation of gases. However, the conventional sputter ion pump has a plurality of disadvantages such as a large size, a heavy weight, and a high fabrication cost. Furthermore, a magnetic leakage may occur, and the leakage could affect any peripheral measuring apparatus (e.g., precision and so on).

A new kind of sputter ion pump invented by Tsinghua University utilizes a saddle-shaped electrostatic-field-restricting electron oscillator. This kind of sputter ion pump is free of a magnetic field. For improving the discharge stability in the high vacuum levels and improving the pumping speed, the sputter ion pump adopts a hot cathode to inject electron beams into a discharge zone. This process can improve the vacuum level in a pressure region lower than $2\times10^{-5}$ Torr. However, the sputter ion pump can only perform the stable discharge process in a narrow region (i.e., in the approximate range from $10^{-3}$ to $10^{-6}$ Torr). Furthermore, the adoption of the hot cathode electron injection results in the sputter ion pump having a complex structure for the electron emission and having a large power consumption.

What is needed, therefore, is a sputter ion pump with a saddle-shaped electrostatic field that is free of a magnetic field, in which the sputter ion pump has a simplified structure and a low power consumption.

SUMMARY

In one embodiment, a sputter ion pump includes one vacuum chamber, two parallel anode poles, and one cold cathode electron emitter. The vacuum chamber includes at least one aperture located on an outer wall thereof, each aperture being configured for an injection of electrons therethrough. The two parallel anode poles are positioned in the vacuum chamber and are arranged in a symmetrical configuration corresponding to a center axis of the vacuum chamber. The cold cathode electron emission device is located on and/or proximate the outer wall of the vacuum chamber and faces a corresponding aperture.

Other advantages and novel features of the present sputter ion pump will become more apparent from the following detailed description of the preferred embodiments when taken in conjunction with the accompanying drawings.

BRIEF DESCRIPTION OF THE DRAWINGS

Many aspects of the present sputter ion pump can be better understood with reference to the following drawings. The components in the drawings are not necessarily drawn to scale, the emphasis instead being placed upon clearly illustrating the principles of the present sputter ion pump. Moreover, in the drawings, like reference numerals designate corresponding parts throughout the several views.

DETAILED DESCRIPTION OF PREFERRED EMBODIMENT

Reference will now be made to the drawings to describe embodiments of the present sputter ion pump, in detail.

Figure 1:
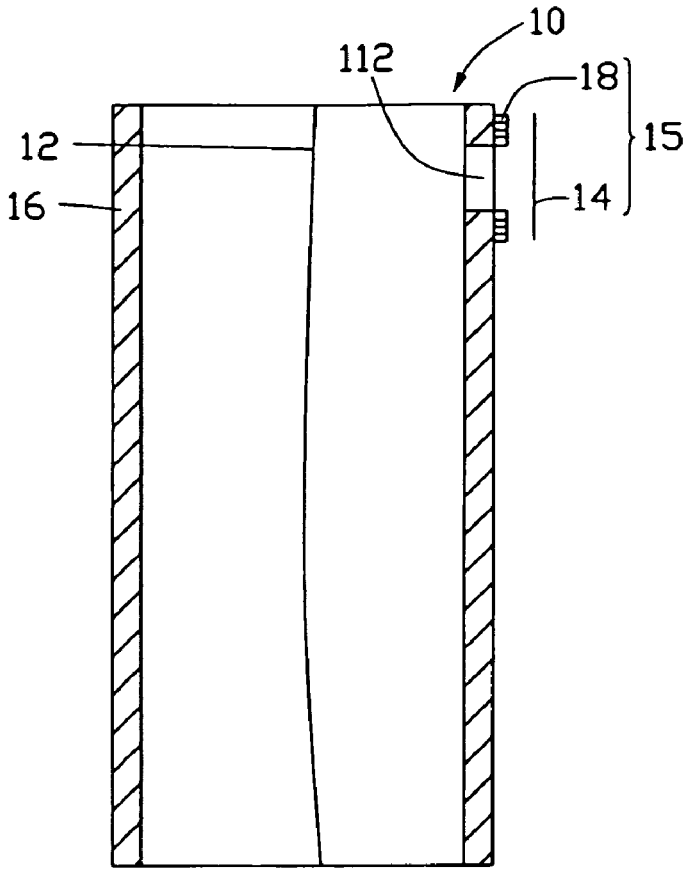
FIG. 1 is a schematic, axial cross-sectional view showing a first embodiment of the present sputter ion pump.
Figure 2:
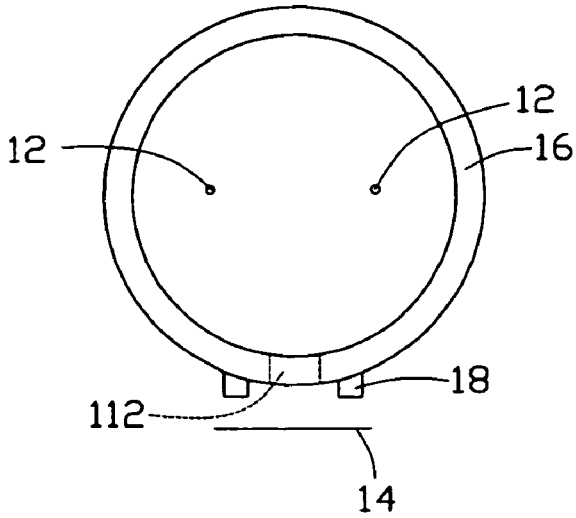
FIG. 2 is a schematic, radial cross-sectional view of the sputter ion pump of FIG. 1.

FIGS. 1 and 2 are schematic axial and radial cross-sectional views, respectively, showing a first embodiment of the present sputter ion pump 10. Referring to FIGS. 1 and 2, the sputter ion pump 10 includes a vacuum chamber 16, two parallel anode poles 12, and a cold cathode electron device 15. The vacuum chamber 16 itself acts as a cathode electrode and includes at least one aperture 112, located on an outer wall (not labeled) thereof, through which electrons can be injected. Furthermore, an electrostatic shield is applied to opposite ends (not labeled) of the vacuum chamber 16 to avoid electrons escaping therefrom.

The vacuum chamber 16 typically has a cylindraceous (i.e., cylindrical or nearly so) shape or a spherical shape. The vacuum chamber 16 is advantageously made of an oxidation-resistant metal or alloy such as a material selected from a group consisting of molybdenum (Mo), steel, and titanium (Ti) and so on. In the preferred embodiment, the vacuum chamber 16 is made of titanium (Ti), has a diameter thereof is about 15 millimeters (mm) and a length thereof is about 55 mm. A diameter of the aperture 112 is in the approximate range from 1 to 2 mm. In the preferred embodiment, the diameter of the aperture 112 is about 1 mm.

The two anode poles 12 are arranged in a symmetrical configuration corresponding to a center axis of the vacuum chamber 16. A center of the aperture 112 is in a plane that extends through the center axis of the vacuum chamber and that is nearly perpendicular to a plane defined by the two anode poles 12. The anode poles 12 can advantageously be made of tungsten (W) or another highly conductive, oxidation-resistant metal. A diameter of each anode pole 12 is about 0.5 mm, and an interval between the anode poles 12 is about 8 mm. Preferably, the anode poles 12 have a certain curvature and are generally oriented along/about the center axis of the vacuum chamber 16. A curvature radius of each anode pole 12 is equal to or greater than about ten times of the radius of the vacuum chamber 16. Thus, each anode pole 12 approaches being a straight line yet still displays a slight though definite curvature. It is because of this slight curvature that the center of the aperture 112 is in a plane that is nearly perpendicular to the plane defined by the two anode poles 12. This anode pole configuration ensures that the injected electrons can spirally oscillate in the vacuum chamber 16 along the center axis thereof.

The cold cathode electron device 15 is located on or proximate the outer wall of the vacuum chamber 16, faces the aperture 112, and is electrically connected to the cathode vacuum chamber 16. The cold cathode electron device 15 includes a cold cathode electron emitter 18, acting as a primary electron source, and a secondary electron emitter 14. The secondary electron emitter 14 is spaced from and faces the aperture 112, and the cold cathode electron emitter 18 is located on the outer wall of the vacuum chamber 16 and faces the secondary electron emitter 14. This arrangement ensures that the electrons emitted from the cold cathode electron emitter 18 can bombard the secondary electron emitter 14, and the secondary electron emitter 14 can thereby yield more secondary electrons to inject into the vacuum chamber 16 through the aperture 112. The cold cathode electron emitter 18 can be any electron emitter structure, such as a carbon nanotube, metal tip, nonmetal tip, compound tip, tube-shaped structure, pole-shaped structure, and/or thin film structure, such as a diamond film and/or a zinc oxide film.

The secondary electron emitter 14 is made of a material having a high secondary electron emission coefficient, such as platinum (Pt), copper (Cu), or alloys thereof.

Figure 3:
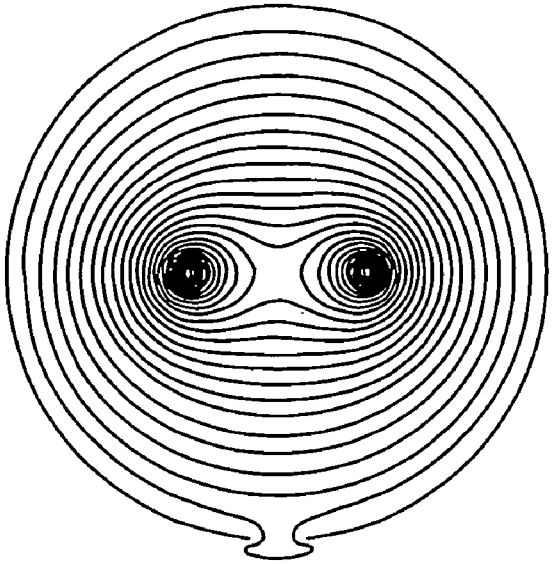
FIG. 3 is a schematic view showing a radial potential distribution of the sputter ion pump of FIG. 1.
Figure 4:
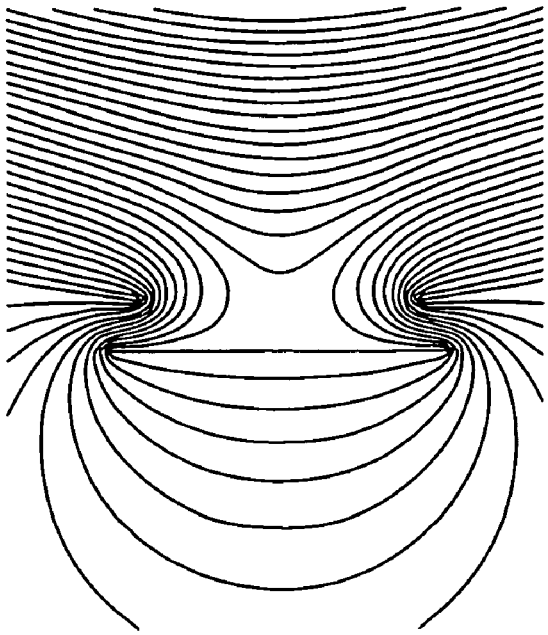
FIG. 4 is a schematic view showing a potential distribution in the vicinity of a secondary electron emitter of the sputter ion pump of FIG. 1.
Figure 5:
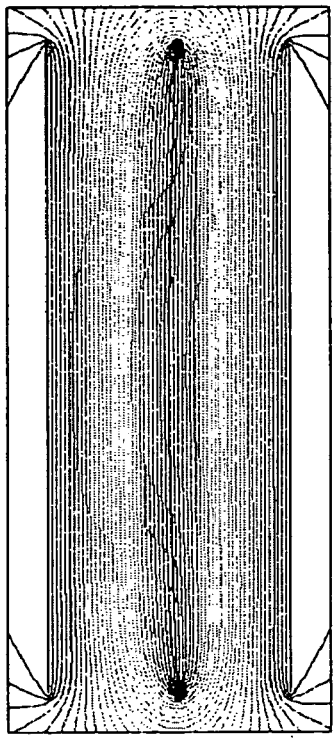
FIG. 5 is a schematic view showing an axial potential distribution of the sputter ion pump of FIG. 1.

Referring to FIGS. 3, 4 and 5, when the sputter ion pump 10 is in operation, the vacuum chamber 16 is connected to a ground voltage. The potentials of the secondary electron emitter 14 and the anode poles 12 can be adjusted according to a size of the sputter ion pump 10, typically 1 kV to 10 kV for the anode poles 12 and 0.4 kV to 1 kV for the secondary electron emitter 14. In the preferred embodiment, the potentials are 10 kV for the anode poles and 0.4 kV for the secondary electron emitter 14. As shown in FIGS. 3, 4 and 5, a saddle-shape electrostatic field is formed inside the vacuum chamber 16. The potential distribution in a vicinity of the aperture 112 can prevent the injected electrons from going back to the secondary electron emitter 14. The sputter ion pump 10 has the evacuation function in principle of the saddle-shape electrostatic field electron oscillator. The sputter ion pump 10 is free of a magnetic field, thereby having a relatively simple structure.

Figure 6:
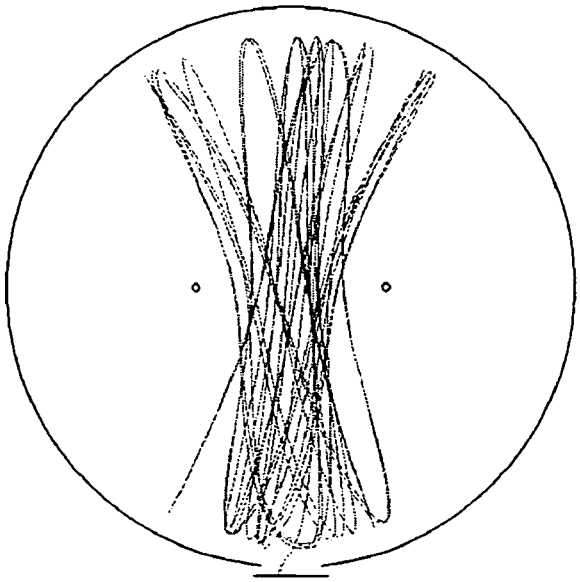
FIG. 6 is a schematic view showing a radial electron movement orbit of the sputter ion pump of FIG. 1.
Figure 7:
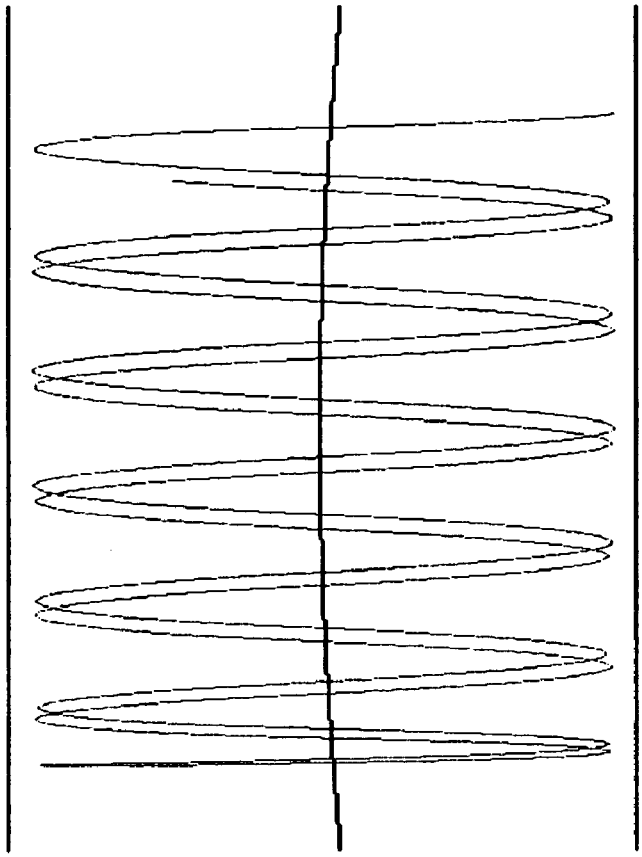
FIG. 7 is a schematic view showing an axial electron movement orbit of the sputter ion pump of FIG. 1.

Referring to FIGS. 6 and 7, in operation, the cold cathode electron emitter 18 emits primary electrons, and then the primary electrons bombard the secondary electron emitter 14 and yield more secondary electrons. The secondary electrons are injected into the titanium vacuum chamber 16 and oscillate frequently in the saddle-shape electrostatic field. The secondary electrons collide with gas molecules, thereby ionizing the gas molecules. The high-energy ions bombard and are effectively retained by an inner surface (not labeled) of the vacuum chamber 16 in the saddle-shape electrostatic field and cause the sputtering titanium atoms. The titanium atoms are re-deposited on the inner surface of the vacuum chamber 16 upon impacting therewith. Thus, the net effect of the sputtering process is an overall reduction of freely-available gases in the vacuum chamber 16, i.e., the gases are evacuated. As shown in FIG. 7, because of the curvature of the anode poles 12, the injected electrons can oscillate along the center axis of the vacuum chamber 16, thus preventing the electrons from going out of the aperture 112 and bombarding the secondary electron emitter 14.

Figure 8:
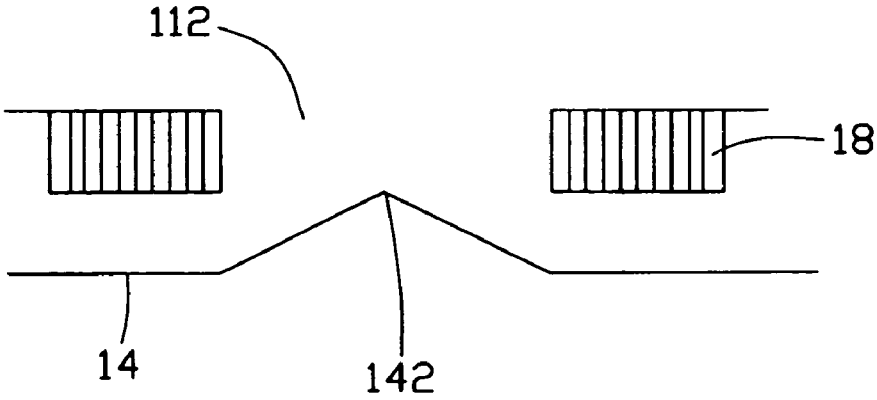
FIG. 8 is a schematic view showing an electron emission device of the sputter ion pump of FIG. 1.

Referring to FIG. 8, the secondary electron emitter 14 can further have a triangular convex structure 142 facing the aperture 112. By adjusting the potential distribution in vicinity of the aperture 112, this configuration can further preventing the electrons from going out of the vacuum chamber 16 via the aperture 116 and bombarding the secondary electron emitter 14. This arrangement can increase the oscillation frequency of the electrons.

Figure 9:
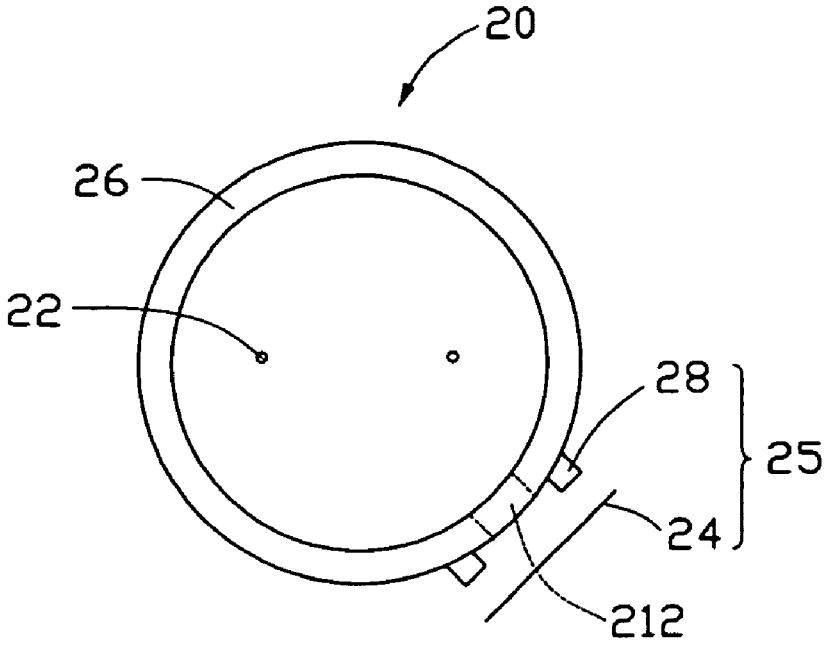
FIG. 9 is a schematic, radial cross-sectional view showing a second embodiment of the present sputter ion pump.
Figure 10:
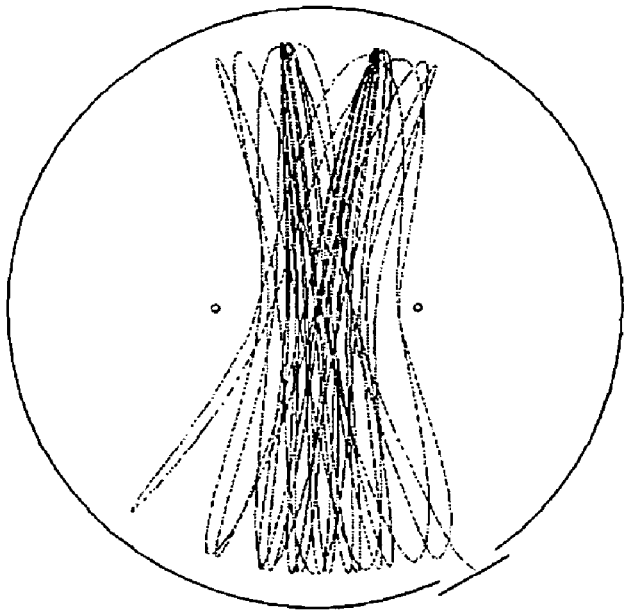
FIG. 10 is a schematic view showing a radial electron movement orbital of the sputter ion pump of FIG. 9.

FIG. 9 is a schematic, radial cross-sectional view showing a second embodiment of the present sputter ion pump 20, and FIG. 10 is a schematic view showing a radial electron movement orbital of the sputter ion pump 20. As shown in FIG. 10, the sputter ion pump 20 is similar to the sputter ion pump 10 in that it includes a vacuum chamber 26, two parallel anode poles 22, and a cold cathode electron device 25, configured similar to the first embodiment. Also similar to the first embodiment, the cold cathode electron device 25 includes a cold cathode electron emitter 28 acted as a primary electron source and a secondary electron emitter 24.

The difference between the sputter ion pump 20 and the sputter ion pump 10 is that an angle is formed between an axially symmetric plane defined by the two anode poles 22 and a plane defined by a center of the aperture 212 and the central axis of the vacuum chamber 20. The angle is advantageously less than 30 degrees, thus not approaching the near perpendicular arrangement associated with such planes in the first embodiment. In this configuration, the injected electrons can spirally oscillate along the center axis of the vacuum chamber 26. This spiral oscillation can further prevent the electrons from going out of the aperture 212 after their initial introduction therethrough and thus from bombarding the secondary electron emitter 24.

It is known that the secondary electron emitter 24 of the sputter ion pump 20 can have a convex structure similar to the secondary electron emitter 14 of the sputter ion pump 10. This configuration increases the amount of electrons that can be injected thereby into the vacuum chamber 26 and can help to prevent the ions from bombarding the secondary electron emitter 24.

In addition, the sizes of any parts of the present sputter ion pump 10 are not limited to the sizes mentioned above and can be adjusted to optimize the working effect. To increase the amount of injected electrons, a plurality of apertures can be arranged in a line and located in the outer wall of the vacuum chamber along the center axis thereof and provided with an accompanying cold cathode electron device. This configuration can result in a relatively large current and a correspondingly improved ability for vacuum creation.

Compared with the conventional pumps, the present sputter ion pump has the following advantages. Firstly, the primary electron emitter is a field emission device, such as a carbon nanotube and so on, and a power supply required therefor is typically only on the order of several milliwatts. This field emission device requires considerably lower power supply than a hot electron emitter. Secondly, by adopting the secondary electron emitter made of a high secondary electron emission coefficient material, such as copper (Cu) or platinum (Pt), more electrons can be injected into the discharge zone and fewer electrons can escape from this zone. This improved net flow of electrons is beneficial to the oscillation of electrons. Thirdly, the angle formed between the axially symmetric plane defined by the two anode poles and the plane defined by the center of the aperture and the central axis of the vacuum chamber can be chosen to be less than 30 degrees, thus helping to substantially reduce, if not prevent entirely, the escape of electrons out of the vacuum chamber through the aperture and from thereby bombarding the secondary electron emitter. Fourthly, because of the relatively large radius of curvature of the anode poles, the electron can spirally oscillate along the center axis of the vacuum chamber, thus preventing the electrons from tending to escape out of the aperture in the first place. Fifthly, the sputter ion pump is free of a magnetic field and has a simpler structure and a lower fabrication cost. Therefore, the present ion pump can be effectively used in high vacuum applications.

Finally, it is to be understood that the above-described embodiments intend to illustrate rather than limit the invention. Variations may be made to the embodiments without departing from the spirit of the invention as claimed. The above-described embodiments illustrate the scope of the invention but do not restrict the scope of the invention.

What is claimed is:

1. A sputter ion pump comprising:

an envelope defining a vacuum chamber therein, the envelope having at least one aperture located in an outer wall thereof;

two parallel anode poles arranged in the envelope in a symmetrical configuration corresponding to a center axis of the envelope; and at least one cold cathode electron emission device completely located outside of the outer wall of the envelope generating a flow of electrons during normal operation, the at least one cold cathode electron emission device facing the at least one aperture, the at least one aperture receiving therethrough the flow of electrons generated by the at least one cold cathode electron emission device.

2. The sputter ion pump as claimed in claim 1, wherein the at least one cold cathode electron emission device comprises a secondary electron emitter facing the at least one aperture and a cold cathode electron emitter facing the secondary electron emitter.

3. The sputter ion pump as claimed in claim 2, wherein the cold cathode electron emitter is comprised of a microtip structure.

4. The sputter ion pump as claimed in claim 3, wherein the microtip structure is comprised of a structure chosen from the group consisting of a carbon nanotube, metal tip, nonmetal tip, compound tip, tube-shaped structure, and pole-shaped structure.

5. The sputter ion pump as claimed in claim 2, wherein the cold cathode electron emitter is a thin film structure comprised of at least one of a diamond film and a zinc oxide film.

6. The sputter ion pump as claimed in claim 2, wherein the secondary electron emitter has a triangular convex structure facing the at least one aperture.

7. The sputter ion pump as claimed in claim 1, wherein an angle formed between a plane defined by the two anode poles and a plane defined by a center of the at least one aperture and the central axis of the envelope is nearly perpendicular.

8. The sputter ion pump as claimed in claim 1, wherein an angle formed between a plane defined by the two anode poles and a plane defined by a center of the at least one aperture and the central axis of the envelope is less than about 30 degrees.

9. The sputter ion pump as claimed in claim 1, wherein the anode poles have a certain curvature and are generally oriented along the center axis of the envelope.

10. The sputter ion pump as claimed in claim 9, wherein a curvature radius of each anode pole is equal to or greater than about ten times of the radius of the envelope.

11. The sputter ion pump as claimed in claim 1, wherein the envelope is made of a material selected from a group consisting of molybdenum (Mo), steel, and titanium (Ti).

12. The sputter ion pump as claimed in claim 2, wherein the secondary electron emitter is made of a material having a high secondary electron emission coefficient.

13. The sputter ion pump as claimed in claim 2, wherein the secondary electron emitter is made of a material selected from a group consisting of platinum (Pt), copper (Cu), and alloys thereof.

14. The sputter ion pump as claimed in claim 8, wherein the at least one cold cathode electron emission device comprises a secondary electron emitter facing the at least one aperture and a cold cathode electron emitter facing the secondary electron emitter.

15. The sputter ion pump as claimed in claim 14, wherein the cold cathode electron emitter is a microtip structure comprised of a structure chosen from the group consisting of a carbon nanotube, metal tip, nonmetal tip, compound tip, tube-shaped structure, and pole-shaped structure.

16. The sputter ion pump as claimed in claim 1, wherein a diameter of each aperture ranges from about 1 mm to about 2 mm.

17. A sputter ion pump comprising:

an envelope defining a vacuum chamber therein, the envelope having an aperture extending through an outer wall thereof;

two anode poles arranged within the envelope;

a secondary electron emitter located outside of the envelope and corresponding to the aperture; and a cold cathode electron emitter located on and outside of the outer wall of the envelope generating a flow of electrons towards the secondary electron emitter during normal operation.

18. The sputter ion pump as claimed in claim 17, wherein the cold cathode electron emitter directly faces the secondary electron emitter.

19. The sputter ion pump as claimed in claim 17, wherein the anode poles are wire-shaped, and both of the anode poles have a radius of curvature equal to or greater than about ten times of the radius of the envelope.

20. A sputter ion pump completely without a magnetic field during normal operation comprising:

an envelope defining a vacuum chamber therein;

a cold cathode electron emitter generating a first flow of electrons during normal operation;

a secondary electron emitter generating a second flow of electrons into the vacuum chamber after being excited by the first flow of electrons during normal operation; and two anode poles arranged within the envelope and generating a saddle-shaped electrostatic field during normal operation, the travel of the second flow of electrons in the vacuum chamber determined by the saddle-shaped electrostatic field; wherein each of the anode poles has a finite curvature.

* * * * *